United States Patent [19]

Silvis et al.

[11] 4,056,184

[45] Nov. 1, 1977

[54] APPARATUS AND METHOD OF POSITIONING SLIDERS

[75] Inventors: Richard R. Silvis, Meadville; John A. Ettinger, Conneaut Lake, both of Pa.

[73] Assignee: Textron Inc., Providence, R.I.

[21] Appl. No.: 660,610

[22] Filed: Feb. 23, 1976

Related U.S. Application Data

[62] Division of Ser. No. 484,906, July 1, 1974, Pat. No. 3,964,615.

[51] Int. Cl.[2] ..... B65G 37/00

[52] U.S. Cl. ..... 198/471; 198/485; 198/610

[58] Field of Search ..... 214/1 BB, 1 R, 1 B, 214/1 P, 1 PB, 1 PA, 89, 622, 623, 152; 29/207.5 R, 207.5 SL, 408, 409; 198/485, 610, 471

[56] References Cited

U.S. PATENT DOCUMENTS

| | | | |
|---|---|---|---|
| 3,116,544 | 1/1964 | Fisher | 29/408 X |
| 3,391,442 | 7/1968 | Thaeler | 29/409 X |
| 3,844,420 | 10/1974 | Walling et al. | 214/1 P |

*Primary Examiner*—Frank E. Werner

[57] ABSTRACT

Sliders are moved single file along a conveyor track to a terminal portion of the conveyor track were the sliders are transferred to a raising member which raises the sliders to a position for assembly on a slider chain. The raising member is an elongated post having facilities for receiving a slider in the top of the post and which is longitudinally moved along a vertical guide path between lowered and raised positions.

6 Claims, 8 Drawing Figures

APPARATUS AND METHOD OF POSITIONING SLIDERS

CROSS REFERENCE TO RELATED APPLICATION

This is a Divisional Application of parent application Ser. No. 484,906 filed July 1, 1974, now U.S. Pat. No. 3,964,615.

BACKGROUND OF THE INVENTION

1. Field of the Invention:

The invention relates to a method and apparatus for positioning sliders to enable an operator to thread the fastener elements of fastener chains into the sliders, and in particular, to a method and apparatus wherein the sliders are automatically raised, one at a time, to a position above a support.

2. Description of the Prior Art:

The prior art, as illustrated in U.S. Pat. No. 2,949,666, 3,110,414, 3,391,442 and 3,644,981 contains a number of methods and apparatus for feeding sliders single file to an assembly station for assembling sliders on fastener chains. In some of the prior art apparatus the sliders are not placed in a raised position or the raising mechanism is bulky, thus the support or raising mechanism interferes with an operator's fingers in feeding the fastener chain into the slider. Another deficiency in prior art slider assembly apparatus is that some slider feeding facilities have members pivoting or moving into engagement with other mechanisms fully exposed to pinch the fingers and hands of an operator thus creating an unsafe and hazardous condition.

The prior art also contains apparatus for automatically assembling slider fasteners on fastener chain as exemplified by U.S. Pat. No. 3,530,563; however, such automatic assembling apparatus is subject to many deficiencies such as being adaptable only for assembling sliders on a continuous slide fastener chain and thus not adaptable for assembling sliders on short fastener chain segments attached to garments, being subject to malfunction, etc.

A number of fixtures or holders for holding sliders in a raised position above a table in an assembly station are described in U.S. Pat. Nos. 2,838,831, 3,685,814 and 3,792,521. In these prior art fixtures the sliders must be positioned by hand within the fixtures, thus requiring an additional step or procedure for an operator in assembling a slider on a slide fastener chain.

SUMMARY OF THE INVENTION

The invention is summarized in that an apparatus for positioning a slider in a slider assembly station includes support means defining a work area, guide means forming a vertical slide path extending upward from the support means, an elongated member, means for longitudinally moving the elongated member from a lowered position to a raised position in the vertical slide path, said elongated member having means for receiving and supporting the slider on the upper end of the elongated member, and means for transferring a slider to the receiving and supporting means of the elongated member when the elongated member is in the lowered position, the elongated member in the raised position protruding substantially above the support means.

An object of the invention is to construct an apparatus for automatically positioning sliders in a raised position in an assembly station in easy access to an operator.

It is also an object of the invention to eliminate hazards presented to an operator by pivoting arms, moving assembly apparatus, and the like.

A further object of the invention is to provide a method of positioning sliders in a slider assembly station wherein the sliders are raised by a vertically sliding member.

Additional features of the invention include the provision of a stop on a conveyor track for sliders which are released automatically when a transfer mechanism transfers a slider from the conveyor track to a raising member; and the provision of automatic facilities for feeding a slider to a raised position when an assembled slider is removed from the raised position.

Other objects, advantages and features of the invention will become apparent from the following description of the preferred embodiment when taken in conjunction with the accompanying drawings.

DESCRIPTION OF THE PREFERRED EMBODIMENT

Figure 1:
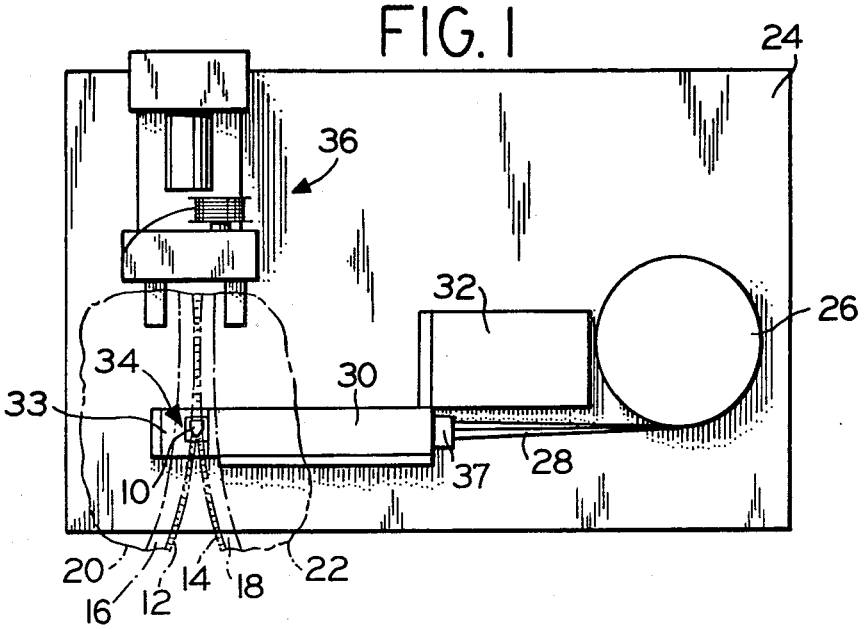
FIG. 1 is a plan view of an apparatus for assembling sliders and applying bottom stops on slider fastener chains in accordance with the invention.

As illustrated in FIG. 1, the invention is embodied in an apparatus and method for raising sliders 10 in an assembly station where the fastening elements 12 and 14 of respective chains or tapes 16 and 18, secured to respective portions 20 and 22 on opposite sides of an opening in a garment, maybe threaded or inserted into the sliders 10.

The apparatus includes a support such as a table top 24 upon which are mounted a hopper 26 for feeding a plurality of sliders single file down a section 28 of a conveyor track which extends beneath a cover 30 suitably attached to the table top 24. A covered motor and friction clutch 32 are mounted in the support 24. A cover 33 surrounds the lower portion of a slider aising mechanism indicated generally at 34 and extending upward from the support 24. A bottom stop applying mechanism indicated generally at 36 is positioned directly behind the raising mechanism 34.

Figure 3:
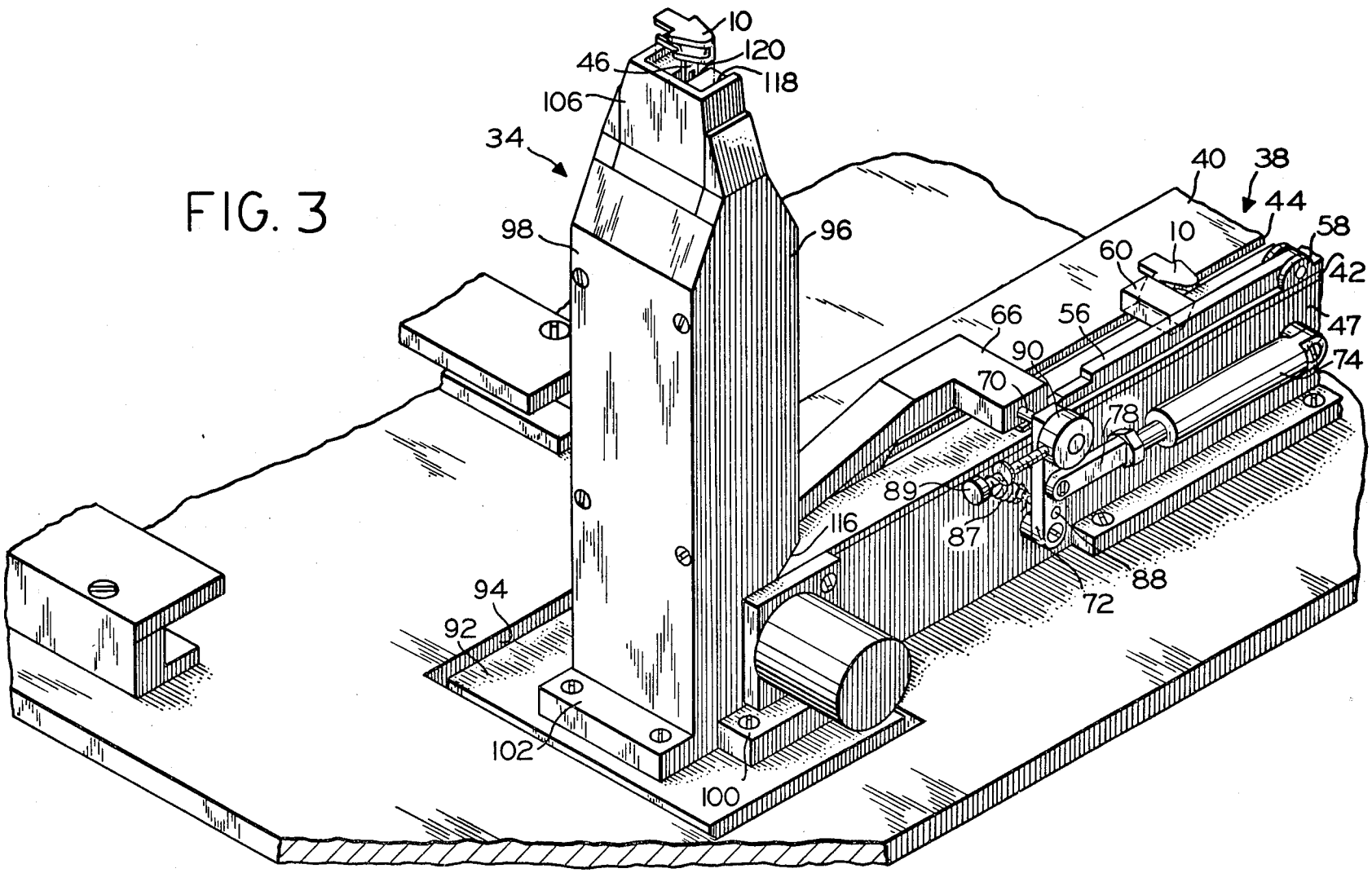
FIG. 3 is a perspective view of a portion containing slider transfer and raising mechanisms, with covers removed, of the apparatus in FIG. 1.
Figure 4:
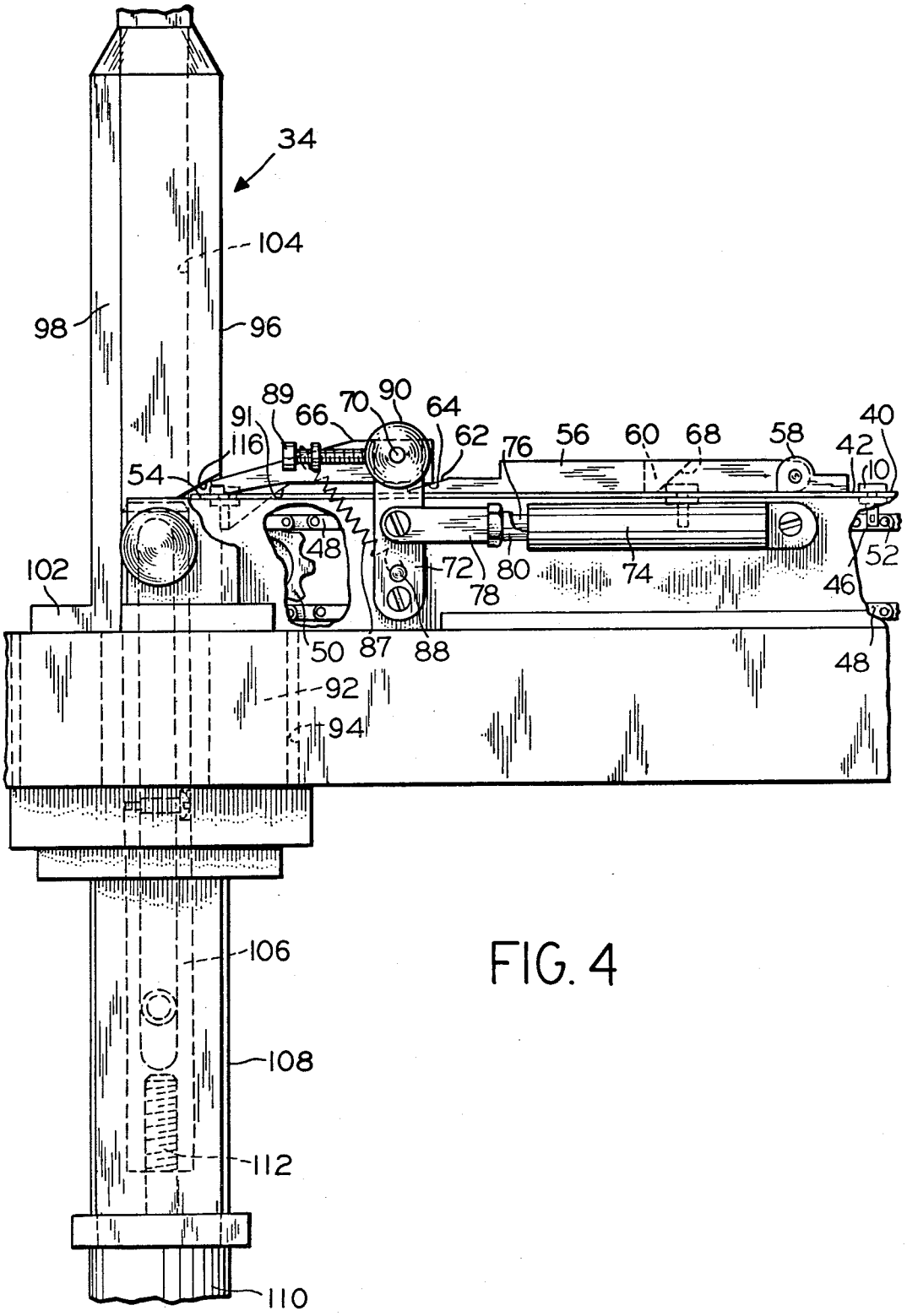
FIG. 4 is a front elevation view, with portions broken away, of the mechanisms shown in FIG. 3.

The hopper 26 is any conventional feeder, such as a vibratory feed bowl, which will receive a supply of sliders 10 and feed the sliders single file with a predetermined orientation down the conveyor track section 28 to a spring biased slider arrester 37. As illustrated in FIGS. 3 and 4, the conveyor track has a section, indicated generally at 38, including a pair of plate members 40 and 42 forming a slot 44 therebetween for receiving and guiding the sliders in single file there along with pull tabs 46 of the sliders 10 extending downward. The plate member 42 is mounted by a suitable bracket member 47 on the support means 24 and a similar facility is provided for supporting the plate member 40. The conveyor track section 38 is such that the sliders 10 are maintained in a predetermined orientation with the width dimension of the pull tabs 46 parallel the slot 44. Moving means, such as a conveyor chain 48 extending over sprockets 50 and having spaced pins 52, is disposed beneath the plate members 40 and 42 and driven by the friction clutch and motor 32 for engaging the downward extending pull tabs 46 of the sliders 10 to strip the sliders, one at a time, from the spring biased slider arrester 37 and to advance the sliders 10 along the conveyor section 38. The motor and friction clutch 32, the conveyor chain 48, the spring biased slider arrester 37, and conveyor track sections 28 and 38 are substantially the same as those described in the U.S. Pat. No. 3,391,442 which is hereby incorporated by reference.

A slider stop member including an arm 56 is pivotally mounted by a pivot member 58 on the plate 42. The stop member has a stop projection 60 extending over the groove 44 in the path of the sliders 10 at a point substantially spaced from a terminal portion 54 of the conveyor track. The extending end of the arm 56 has an inclined surface 62 for being engaged by a lower edge or surface 64 of a transfer member 66 in a retracted position. The surface 64 and the incline 62 are arranged such that the transfer member 66 clamps the arm 56 against the plate member 42 when the transfer member 66 is in the retracted position. The stop projection 60 has a camming surface 68 on its rear lower edge thereof for engaging the bodies of sliders 10. The caming surface 68 is formed at about 45° angle to the conveyor track section 38 such that the force exerted by the motor and friction clutch 32 on the conveyor chain 48 is sufficient to raise the arm 56 and allow the sliders 10 to advance on the conveyor track when the incline 62 is not clamped by the transfer member 66.

Figure 6:
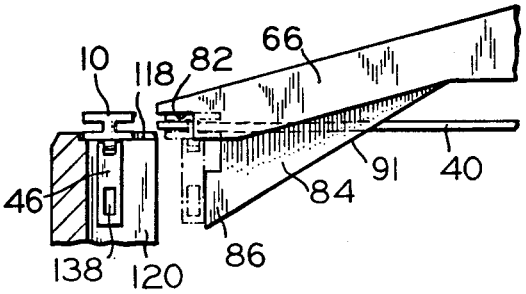
FIG. 6 is a detailed front elevation view partially in cross section of the upper end of a slider raising member and the left end of a slider transferring member of the mechanisms shown in FIGS. 3 and 4.

The transfer member 66 is secured to a shaft 70 which is pivotally mounted in one end of a lever 72 which has its other end pivotally secured to the bracket 47. An air cylinder 74 is pivotally secured at one end to the bracket 47 and has a piston rod 76 with a clevis 78 pivotally connected to a mid point of the lever 72 for pivoting the lever 72 when the piston rod is advanced. A sleeve 80 is positioned over the piston rod 76 between the clevis 78 and the other end of the air cylinder 74 in order to set a retracted position for the piston rod 76 in the air cylinder 74. As shown in FIG. 6, the transfer member 66 at its projecting end has a recess 82 which is suitably formed to mate with the contour of the body of the sliders 10. A narrow extension 84 extends downward from the top portion of the transfer member 66 within the groove 44 and has an end portion 86 which is designed to engage the pull tabs 46 of the sliders 10 to insure even transfer of the sliders. A tension spring 87 is secured at one end to a pin 88 on the lever 72 and at its other end to a bolt 89 extending from a collar 90 attached to the shaft 70 such as to normally urge the projecting end of the transfer member against the conveyor track section 38. The extension 84 has a lower camming surface 91 for being engaged by an advancing slider 10 to lift the transfer member 66 from the conveyor track section 38 to allow the slider to pass beneath the transfer member 66.

The raising mechanism 34, as illustrated in FIGS. 3 and 4 includes a base 92 suitably mounted within an opening 94 formed through the table top 24. A vertical tubular guide has an elongated vertical member 96 with U-shaped cross section enclosed by a plate member 98 to form an internal passageway or vertical slide path 104 for an elongated raising member or post 106. The members 96 and 98 have suitable flanges 100 and 102 mounting them on the base 92 to extend vertically above the table top 24. A frame 108 suitably attached to the bottom of the base 92 supports an air cylinder 110 which has a piston rod 112 secured to the bottom of the elongated member 106 for raising and lowering the elongated member 106 longitudinally within the guideway 104. The member 96 has an opening 116 wherein the terminal point 54 of the conveyor track extends to a position adjacent the guideway 104 and the elongated member 106. The raising mechanism 34 is designed such that the elongated member 106 when its lowered position has its upper end substantially aligned with the conveyor track section 38.

The upper end of the elongated raising member 106 has a recess 118 suitably formed to receive and support the body of the slider 10 from the terminal position 54 of the conveyor track. A slot 120 is formed extending downward from the recess 118 to receive the pull tab 46.

Figure 5:
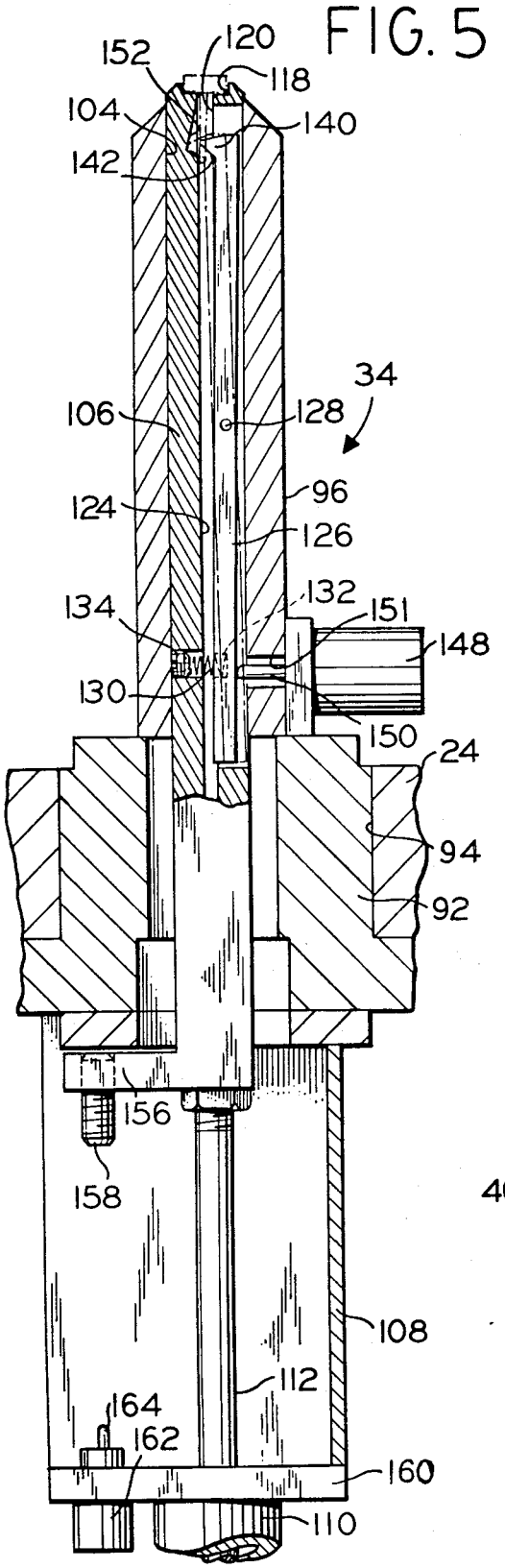
FIG. 5 is a elevation view taken from the left side and partially in cross section of the slider raising mechanism shown in FIGS. 3 and 4.
Figure 7:
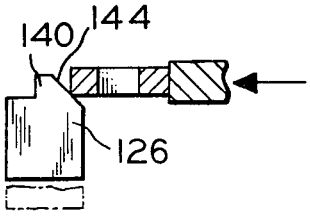
FIG. 7 is a detailed top view partly in cross section of a slider retaining and sensing lever, a slider pull and a slider transfer member of the mechanisms shown in FIGS. 3 and 4.

As shown in FIG. 5 the raising member 106 has an elongated cavity 124 in which a lever 126 is pivotally mounted on a pin 128. A compression spring 130 is mounted between a recess 132 in the lower end of the lever 126 and a set screw 134 in the raising member 106 for urging the lever 126 counter clockwise about the pivot pin 128 as shown in FIG. 5. The upper end of the lever 126 has a transverse projection 140 for entering an aperture 138, FIG. 6, of the pull 46 when the pull 46 is within the slot 120. The lower surface 142 of the projection 140 is formed at an angle of about 55 degrees from the vertical axis to engage the bottom of the aperture 138 in the pull tab 46 and cam the pull tab 46 downward to open a spring lock of the slider 10. As illustrated in FIG. 7, the projection 140 also has a side camming surface 144 which is formed at approximately a 45° angle to the slot 120 and the path of movement for the pull tab 46 so that the pull tab 46 will engage the projection 140 camming the lever 126 to rotate the lever 126 against the force of the spring 130 to allow the pull tab 46 and the slider 10 to be transferred into the upper end of the raising member 106. As illustrated in FIG. 5, a sensing means such as a air pulse valve 148 is mounted on the front of the member 96 and has an operator 150 extending through an opening 151 into the cavity 124 for sensing the position of the lever 126. The valve 148 is designed to be operated when the slider 10 is removed allowing the lever 126 to pivot and thus engage the lower end of the lever 126 against the operator 150 of the valve 148. A suitable recess 152 is formed adjacent the upper end of the member 126 opening into the cavity 124 for accomodating the projection 140 of the lever 146 to thus allow the lever 126 to pivot and operate the valve 148.

The lower end of the slider raising member 106 has a horizontally extending projection 156 in which is vertically mounted a limit screw 158. A horizontal portion 160 of the frame 108 carries an air pulse valve 162 which has an operator 164 extending in alignment with the limit screw 158. The limit screw 158 is adjusted to operate the pulse valve 162 when the slider raising member 106 reaches its lower position.

The pulse valves 148 and 162 are valves which will pass a pulse of air from an input to an output when the operator 150 and 164 respectively are operated. An example of a suitable pulse valve is model MAV3 sold by Clifford Instrument Laboratory, Inc. 7390 Colerain Rd. Cinncinati, Ohio, U.S.A.

Figure 8:
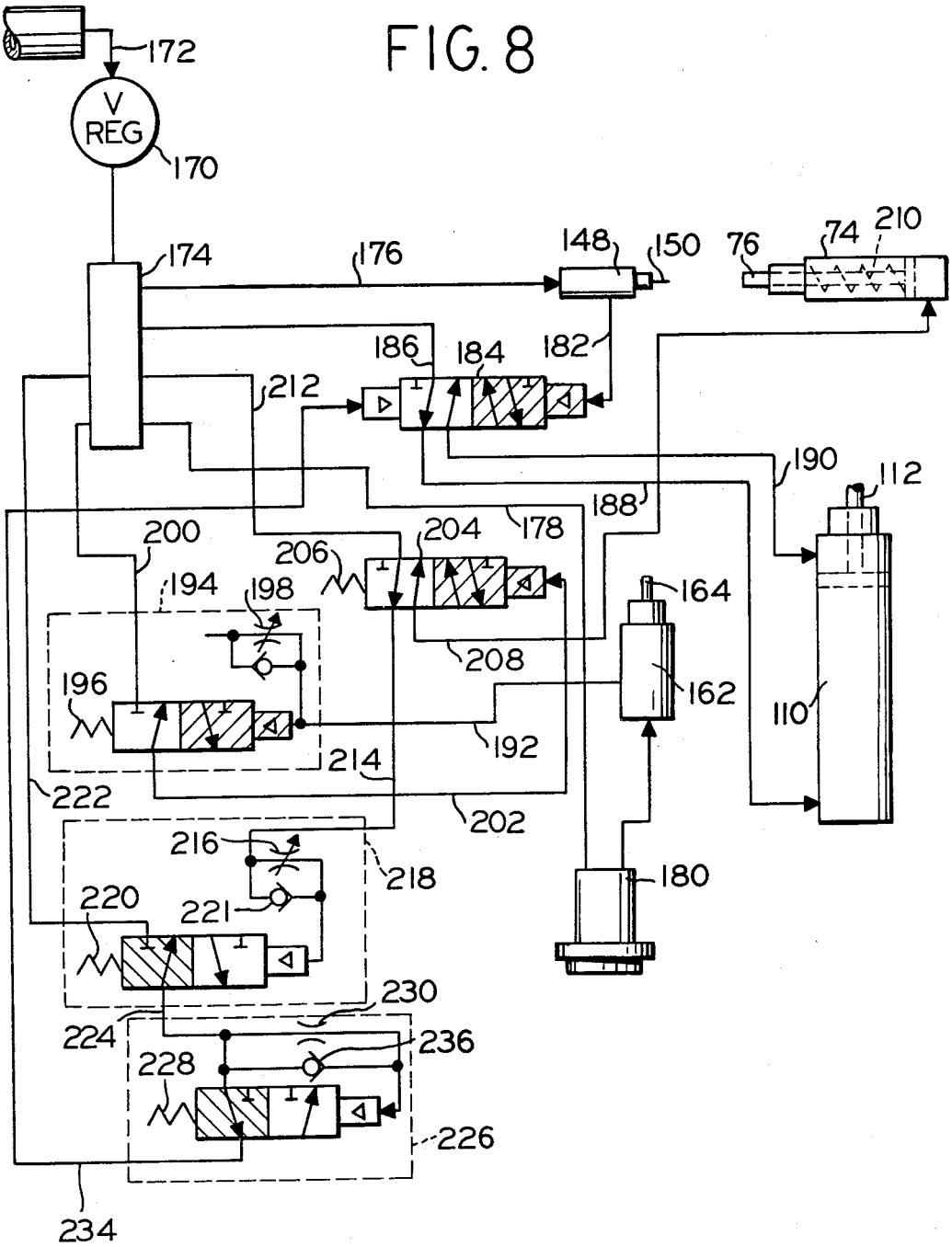
FIG. 8 is a diagram of a pneumatic control circuit for the apparatus of FIG. 1.

The air control circuit for the slider positioning apparatus, as illustrated in FIG. 8, has a pressure regulator valve 170 connected between an input line 172 from a pressurized air source and a manifold 174 which is connected by line 176 to the input of valve 148 and by line 178 and a manual selector valve 180 to the input of the valve 162. The output of the valve 148 is connected by a line 182 to a first pilot input of a four-way valve 184 such that the pressure on the line 182 will shift the valve 184 from its normal or unoperated state to its operated state. A line 186 is connected from the manifold 174 to an input of the valve 184 which in the unoperated state connects the input to a first output connected by line 188 to an advance input of the air cylinder 110. A second output of the valve 184 connected to an exhaust port in the unoperated state communicates through line 190 to the retract input of the air cylinder 110. The valve 184 is such that the outputs are reversed when the valve is operated, i.e., line 190 is connected to line 186 and line 188 is connected to the exhaust port.

The output of the valve 162 is connected by a line 192 to a pilot input of a three-way delayed-out normally closed valve 194 which has a spring 196 urging the valve 194 to its closed position. The pilot input of the valve 194 has a variable restriction 198 connected to an exhaust port so that after a pulse of air on line 192 the valve 194 will remain operated for a duration until the pressure in line 192 decreases by bleeding through the restriction 198 thus allowing the valve 194 to return to its normal or unoperated state. The input of the valve 194 is connected by line 200 to the manifold 174 while the output of the valve 194, connected to an exhaust port in the unoperated state of the valve 194, is connected by line 202 to a pilot input of a four-way valve 204 which has a spring 206 normally urging the valve 204 to its normal or unoperated state. The pilot input connected to the line 202 is such that upon pressure the valve 204 is changed to its operated state. The normally exhausted output of the valve 204 is connected by line 208 to the advance input of the air cylinder 74 which has a spring 210 normally urging the piston rod 76 to its retracted position.

The output of the valve 204, which is normally connected to the input communicating over line 212 with the manifold 174, is connected by line 214 in series with a variable restriction 216 to a pilot input of a three-way delayed-in valve 218 which has a spring 220 normally urging valve 218 closed. A one-way valve 221 is connected in parallel with the restriction 216 so that the pilot input of valve 218 may be rapidly exhausted through line 214 and valve 204. The input of the valve 218 is connected by line 222 to the manifold while the output of the valve 218 is connected by line 224 to the input of an impulse valve 226. The impulse valve 226 has a spring 228 normally urging the valve 226 closed and a restriction 230 connected between the input and a pilot input for operating the valve 226 after a delay to open the valve 226. A one-way valve 236 is connected in parallel with the restriction 230 so that the pilot input of valve 226 may be rapidly exhausted through line 224 and valve 218. The output of the impulse valve 226 is connected by line 234 to the second pilot input of the valve 184.

Figure 2:
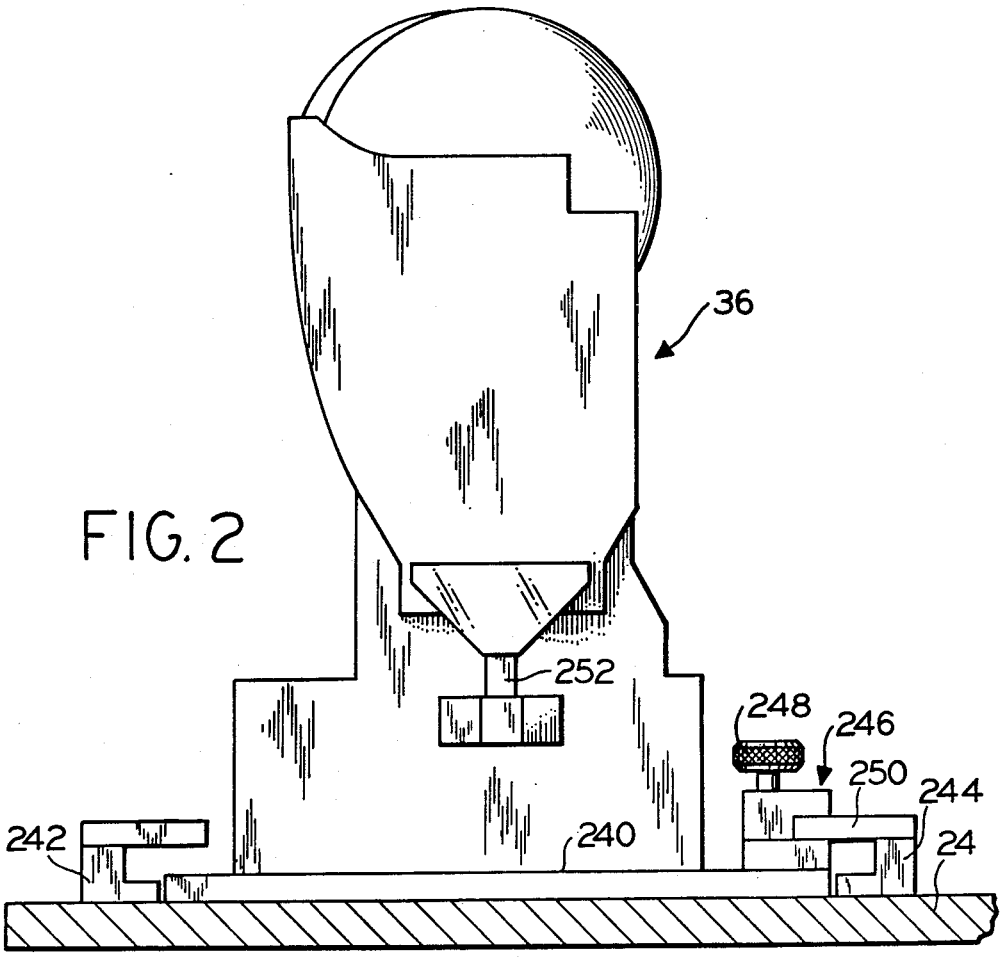
FIG. 2 is a front elevation view of a broken away portion containing a bottom stop applying mechanism of the apparatus in FIG. 1.

Referring to FIG. 2 the bottom stop applying mechanism 36 includes a conventional bottom stop applying mechanism which is mounted upon a base 240 slidable between respective guide members 242 and 244 mounted upon the support means 24. A clamp indicated generally at 246 is provided with a operating bolt 248 to clamp the base 240 to a overlying ridge or flange 250 of the guide 244.

In operation of the apparatus of FIG. 1 for assembling sliders and bottom stops on slide fastener chains, the sliders 10 are automatically positioned, one at a time, by the raising mechanism 34 in front of the operator at the assembly station. Separated fastener elements 12 and 14 on slider chains 16 and 18 are inserted or threaded into the slider 10 and pulled partially therethrough to assemble a slider 10 and the chains 16 and 18. In the same motion used in pulling the slider chains 16 and 18 through the slider 10, the operator positions the bottom end of the slide fastener over the anvil 252, FIG. 2, in the bottom stop applying apparatus 36. The bottom stop apparatus 36 is then activated in a conventional manner to apply a bottom stop to the assembled slide fastener chain.

In positioning and feeding the sliders 10 to the assembly station, the sliders 10 are oriented in the hopper 26 and fed single file down the conveyor track section 28 to spring slider arrester 37. The downward extending pull tab 46 of the first slider at the slider arrester 37 is engaged by a pin 52, see FIG. 4, of conveyor chain 48 to advance the sliders 10, one at a time, from the conveyor track section 28 through the slider arrester 37 onto the conveyor track section 38. The sliders 10 are advanced along the conveyor track section 38, particularly plate members 40 and 42, single file and in spaced relationship by the conveyor chain 48 until a leading or first of the sliders 10 on the conveyor track section 38 reaches the terminal portion 54 where the first slider abuts the raising member 106 in the raised position, FIGS. 3 and 5, to slip the clutch in the friction clutch and motor 32 and thus stop the conveyor chain 48. In the event the pin 52 engaging the slider at the terminal position 54 disengages the respective pull tab, the second of a series of sliders on the conveyor track section 38 engages the camming surface 68 of the projection 60 thus stopping the conveyor chain 48 to prevent pile-up of the sliders at the terminal point 54.

Referring to FIG. 5 when an assembled slider 10 in the raising mechanism 34 is removed from the recess 118 on top of the raising member 106, the lever 126 pivots counter clockwise under the force of spring 130 to engage the bottom end of the lever 126 against the operator 150 and operate the air pulse valve 148. In FIG. 8 the states of the valves 184, 194, 204, 218 and 226, prior to removal of a slider 10 from the member 106 in its raised position, is shown by the non-hatched operationing conditions. When the valve 148 is operated, it passes a pulse of air from the line 176 to the line 182 which operates the four-way valve 184 connecting the line 186 to line 190 and connecting line 188 to exhaust to retract the piston rod 112 and lower the slider raising member 106, FIG. 4, within the guideway 104. When the slider raising member reaches its lowered position, the force of the pin 52 on the pull tab 46 of the first slider at the terminal position 54 partially pushes the first slider into the recess 118 until the pin slips off the pull tab 45 allowing the conveyor chain 48 to advance. Also when the slider raising member 106 reaches the lowered position, the limit screw 158 engages the operator 164 of the valve 162 to pass a pulse of air from the line 178 through the manual valve 180 and valve 162 to line 192. The pulse of air on line 192 operates the three-way valve 194 thus connecting the supply line 200 to the line 202 to operate the four-way valve 204. Operation of the valve 204 disconnects the supply line 212 from the line 214 and connects the supply line 212 to line 208 to supply air to the air cylinder 74 to advance the piston rod 75 which, as shown in FIGS. 4 and 6 pivots the arm 72 advancing the transfer member 66 to engage the recessed end 82 of the transfer member with the first slider on the terminal portion of the conveyor track section 38 to complete the transfer of the slider 10 into the recess 118 on the top of the slider raising member 106. When the slider is inserted into the recess 210 of the raising member 106 in its lowered position the pull tab 46 engages the camming surface 144, FIG. 7, of the projection 140 on the lever 126 thus forcing the lever 126 to pivot against the force of the spring 130 to allow insertion of the pull tab 46. Subsequently the force of the spring 136 pivots the lever 126 back inserting the projection 140 into the aperture 138 of the pull tab 46 to engage the camming surface 142 against the bottom surface of the aperture 138 to force the pull tab downward to open the locking spring in the slider to allow easy insertion of the fastening elements 12 and 14 of the slider chain.

After a duration from the end of the pulse of air on the line 192, the bleeding of air pressure from line 192 through the restriction 198 allows the spring 196 to return the valve 194 to its unoperated condition. Thus the valve 194 closes the end of line 200 and connects line 202 to exhaust which allows the spring 206 to return the valve 204 to its normal or unoperated state which disconnects line 212 from the line 208 and connects line 208 to exhaust, thus allowing the spring 210 in the air cylinder 74 to return the piston rod 76 to its retracted position.

When the transfer member 66 has been advanced during operation of the air cylinder 74, the bottom surface 64 of the transfer member 66 is disengaged from the incline 62 on the arm 56 to allow the force of the second slider 10 on the conveyor track section 38 engaging the camming surface 68 to lift the projection 60 and arm 56 and advance the second slider beneath the projection 60. When the piston rod 76 is retracted, the lever 72 pivots back retracting the transfer member 66. When the first slider 10 now on the conveyor track section 38 engages the bottom camming surface 91 of the transfer member 66, the first slider cams the member 66 upwardly against the force of the spring 87 to pass the first slider 10 to the terminal portion 54 of the conveyor track. The transfer member 66 will pivot back onto the conveyor track into position for transferring another slider into the slider raising member 106.

Also when the valve 204 is operated, the line 214 is connected to exhaust allowing air through one-way valve 221 to exhaust whereby the spring 220 returns the valve 218 to its closed position where line 224 is connected to exhaust. Exhausting line 224 removes air pressure from the pilot input of pulse valve 226 through one-way valve 232 which resets the pulse valve 226.

Now when the valve 204 returns to its unoperated or normal state, the air supply line 212 is connected to line 214 which applies air through the restriction 216 to the pilot input of three-way valve 218. After a delay determined by the restriction 216 and the volume of air required to operate the valve 218, the valve 218 operates to connect the line 222 to line 224. Air pressure on line 224 to the pulse valve 226 passes a pulse of air over line 234 to the second pilot input of the four-way valve 184 thus returning the valve 184 to its normal or unoperated state. Air through restriction 230 after a delay operates the valve 226 to terminate the pulse of air on line 234. When the valve 184 returns to its normal state the supply line 186 is connected to the line 188 while the line 190 is connected to exhaust to advance the piston rod 112 of the air cylinder 110 thus raising the slider raising member 106, FIGS. 3 and 5 to present another slider in a raised position in the assembly station.

It is particularly advantageous that the sliders 10 are supported upon a vertically slideable elongated member 106 which extends substantially above the support or table top 24. By utilizing a slideable vertically elongated member 106 which has a cross section only slightly larger than the sliders, the sliders are substantially free of any obstructions on the support or slider conveyor mechanism to the sides, the front and the rear which would interfere with the freedom of access by an operator's fingers and hands in inserting the slider chains 16 and 18 into the slider 10. Additionally the conveying mechanism and transfer mechanism is located near the table top 24 where the conveyor and transfer are covered by the covers 30 and 33 to eliminate any hazard to fingers and hands. Further utilizing a longitudinal member which slides longitudinally in a vertical guide path to raise the slider from a lowered position to a raised position eliminates the problem of pinching fingers caused by rotating members which are used in some prior art apparatus.

Since many variations, modifications and changes in detail may be made to the described apparatus and method of positioning sliders, it is intended that all matter in the foregoing description and the accompanying drawings be interpreted as illustrative and not in a limiting sense.

What is claimed is:

1. An apparatus for positioning a slider in a slider assembly station, comprising support means defining a work area, a conveyor track having entrance means and a terminal point and forming a path for guiding sliders single file from the entrance means to the terminal point of the conveyor track, friction driven moving means having spaced means for engaging sliders to simultaneously move a series containing a plurality of the sliders in spaced relationship along the conveyor track from the entrance means toward the terminal point, raising means adjacent the terminal point for raising a slider from a lowered position to a raised position above the terminal point, means including a projection extending into the path of the sliders for engaging a second of the series of sliders on the conveyor track at a position spaced from the terminal point to stop the moving means to prevent pile-up at the terminal point, transfer means for transferring the first slider from the terminal point of the conveyor track to the raising means in a lowered position, and means responsive to operation of the transfer means for releasing the projection to allow the series of sliders to advance along the conveyor track.

2. An apparatus for positioning a slider in a slider assembly station comprising support means defining a work area;

a conveyor track having entrance means and a terminal point and forming a path for guiding sliders single file from the entrance means to the terminal point of the conveyor track;

friction driven moving means for engaging sliders to move the sliders along the conveyor track from the entrance means toward the terminal point;

raising means adjacent the terminal point for raising a slider from a lowered position to a raised position above the terminal point;

means for stopping a second of the series of sliders on the conveyor track at a position spaced from the terminal point to prevent pile-up at the terminal point;

transfer means for transferring the first slider from the terminal point of the conveyor track to the raising means in a lowered position;

means responsive to operation of the transfer means for releasing the stop means to allow the sliders to advance along the conveyor track;

the transfer means including a transfer member, and means for moving the transfer member from a retracted position to an advanced position to push the first slider from the terminal track into the raising means; and the stop means including a lever pivotally mounted adjacent the conveyor track, a projection on the lever extending in the path of sliders on the conveyor track, and means operated by the transfer means in the retracted position for preventing movement of the lever, said projection having a camming surface for engaging the second slider to stop the second slider when the transfer means is in the retracted position and to pivot the lever when the transfer means is in the advanced position to allow advancement of the sliders along the conveyor track.

3. An apparatus for positioning the slider in the slider assembly station, comprising support means including a horizontal table top, a conveyor track including first and second section, means for receiving a plurality of sliders and for feeding sliders single file in a predetermined orientation along the first conveyor track section, said second conveyor track section extending horizontally at least adjacent the table top for receiving sliders with bodies of the sliders extending horizontally, said second conveyor track further having a slot and means for guiding sliders with pull tabs of the slider extending downward such that the width dimension of the pull tabs are oriented longitudinally relative to the slot a conveyor chain beneath the second conveyor track section and having a plurality of spaced pins projecting to engage pull tabs extending downward from sliders in the second conveyor track section, means including a friction clutch for driving the conveyor chain, a vertical tubular guide mounted on the table top and extending upward from the table top, said tubular guide having an opening near the lower end thereof and into which opening a terminal portion of the second conveyor track section extends, an elongated slider raising member slidably mounted in the tubular guide, said slider raising member having a recess in the top thereof for receiving a body of a slider and having a slot exposed towards the conveyor track and aligned with the slot in the second conveyor track section for receiving the pull tab of the slider, said slider member having an elongated internal cavity longitudinally therein and into which the slot of the slider raising member opens, a lever pivotally mounted within the cavity for pivoting in a plane perpendicular to the slot, said lever having a projection on one end with a first cam surface formed at an angle of about 45 degrees to the slot for being engaged by a pull tab on a slider, said projection having a second cam surface on the lower portion thereof formed at an angle of about 55 degrees to a vertical line for engaging the bottom of an aperature in a pull tab to urge the pull tab downward, a spring disposed in the cavity for engaging the lever in the cavity to urge the lever to pivot into engagement with a pull tab in the slot of the raising member, said conveyor chain and said second conveyor track section arranged so that a first of a series of sliders on the terminal portion of the second conveyor track section engages the slider raising member in its raised position to stop the conveyor chain, said pins of the conveyor chain disengaging sliders when the sliders are partially pushed into the recess and slot of the slider raising member in its lowered position, an arm pivotally mounted at one end and having its other end extending vertically above the second conveyor track section near the terminal portion, an elongated transfer member pivotally mounted on the other end of the arm and extending longitudinally over the slot in the second conveyor track section toward the terminal portion, said transfer member having an end with a recess formed therein for engaging a body of a slider in the terminal portion;

said transfer member having a portion extending downward into the slot for engaging a pull tab of a slider at the terminal portion, said downward extending portion of the transfer member having a lower camming surface for being engaged by a slider advancing along the second conveyor track section to pivot the transfer member and raise the transfer member from the second conveyor track section to allow a slider to pass to the terminal portion, an elongated stop member pivotally attached at one end thereof to the second conveyor track section, said stop member having its other end inclined downward and extending toward the terminal portion of the second conveyor track section parallel to the slot in the second track portion, a first air cylinder moving the slider raising member between raised and lowered position, a second air cylinder pivotally attached to a mid point of the arm for pivoting the arm to move the transfer member from a retracted position toward an advanced position to complete the pushing of a slider from the terminal portion of second conveyor track into the recess and slot of the slider raising member, said transfer member having a lower surface portion for engaging the inclined end of the stop member to clamp the stop member against the second conveyor track section, said stop member having a projection extending transversely over the slot in the second conveyor track portion, said projection on the stop member having a rear camming surface formed at about a 45° angle with the second conveyor track section for being engaged by a body of a slider to stop the slider when the transfer member is in the retracted position and to raise the stop member when the transfer member is in the advanced position to allow advancement of sliders on the second conveyor track portion, a cover extending over the second conveyor track section, the transfer member, the arm, the second air cylinder, and the stop member, a first air pulse valve mounted on the tubular guide member and having a operator extending into the cavity of the slider raising member for operating the first air pulse valve in response to a pivotal position of the level in the cavity indicating absence of a slider when the slider raising member is in the raised position, a first four-way valve responsive to the first pulse valve for operating the first air cylinder to move the slider raising member to its lowered position, a second air pulse valve having an operator for sensing the lowered position of the slider raising member, a first three-way valve responsive to the second air pulse valve for operating a continuous predetermined time duration after operation of the second air pulse valve, a second four-way valve responsive to the predetermined continuous operation of the first three-way valve for operating the second air cylinder, a second three-way valve for operating in response to the termination of the operation of the second four-way valve, and a third pulse valve responsive to operation of the second three-way valve for returning the first four-way valve to its unoperated state to raise the slider raising member.

4. A method of positioning sliders in a slider assembly station comprising engaging a series of sliders with respective spaced pins on a friction driven moving means to feed the series of sliders single file along a conveyor track to a terminal position on the conveyor track adjacent a vertically elongated slider raising member, engaging a projection with a second of the series of sliders on the conveyor track at a position spaced from the terminal position to stop the moving means to prevent more than one slider at the terminal position, longitudinally lowering the slider raising member until the upper end thereof is aligned with the conveyor track, transferring a first slider from the terminal position on the conveyor track into slider receiving means in the upper end of the slider raising member, longitudinally raising the elongated member to position the first slider substantially above a support means in the assembly station, and releasing the projection to permit the moving means to allow advancement of the series of sliders along the conveyor track.

5. A method as claimed in claim 4 wherein the first slider is transferred from the terminal position to the upper end of the elongated slider raising member by a transfer member pushing the slider off the terminal position and into the slider raising member.

6. A method as claimed in claim 4 wherein the absence of a slider in the slider receiving means of the slider raising member is sensed, and the lowering of the slider member is in response to said sensing.

* * * * *